United States Patent [19]

Wise

[11] 4,398,900

[45] Aug. 16, 1983

[54] METHOD OF FORMING PAPERBOARD BLANKS FOR LIQUID CONTAINER WITH STRAW OPENING MEANS

[75] Inventor: Daniel J. Wise, Farmington, Mich.

[73] Assignee: Ex-Cell-O Corporation, Troy, Mich.

[21] Appl. No.: 217,884

[22] Filed: Dec. 18, 1980

Related U.S. Application Data

[62] Division of Ser. No. 47,658, Jun. 11, 1979, Pat. No. 4,244,474.

[51] Int. Cl.[3] ..... B31B 1/20

[52] U.S. Cl. ..... 493/62; 493/87

[58] Field of Search ..... 493/87, 86, 59–62, 493/74; 229/17 G, 17 R

[56] References Cited

U.S. PATENT DOCUMENTS

| | | | |
|---|---|---|---|
| 1,793,073 | 2/1931 | Field et al. | 229/17 R |
| 2,226,049 | 12/1940 | Carley | 493/87 X |
| 2,324,807 | 7/1943 | Wentz | 229/17 G |
| 2,390,909 | 12/1945 | Zinn, Jr. | 229/17 G |
| 2,395,352 | 2/1946 | Staude et al. | 493/87 X |
| 2,576,594 | 11/1951 | Goldstein | 493/87 X |
| 2,661,138 | 12/1953 | Leonard | 229/17 G |
| 3,120,335 | 2/1964 | Egleston et al. | 229/17 G |
| 3,770,185 | 11/1973 | Reeves | 206/612 |

FOREIGN PATENT DOCUMENTS

| | | | |
|---|---|---|---|
| 678370 | 1/1964 | Canada | 229/17 G |
| 670982 | 4/1952 | United Kingdom | 229/7 S |
| 861079 | 2/1961 | United Kingdom | 229/7 S |

*Primary Examiner*—James F. Coan

*Attorney, Agent, or Firm*—John P. Moran

[57] ABSTRACT

The accompanying description and drawings disclose a method of forming a paperboard blank for a gable top type liquid carrying paperboard carton having straw opening means formed in a side panel of the gable top closure structure. The straw opening means includes a tear strip formed by cuts at least halfway through the carton wall beginning at the score line formed at the edge of the side panel adjacent the usual underlying side seam flap. In an alternate embodiment wherein the side seam flap is formed on the reverse end of the carton blank, a tab is formed from material available from the adjacent blank during the scoring and cutting process, and serves as an extension of the tear strip beyond the edge of the gable top side panel.

2 Claims, 7 Drawing Figures

METHOD OF FORMING PAPERBOARD BLANKS FOR LIQUID CONTAINER WITH STRAW OPENING MEANS

This is a division of application Ser. No. 47,658, filed June 11, 1979, now U.S. Pat. No. 4,244,474.

DESCRIPTION

1. Technical Field

This invention relates generally to liquid proof, paperboard cartons or containers, and, more particularly, to such containers provided with improved means for readily forming an opening for a straw therein.

It is essential that liquid carrying paperboard containers reach the consumer in a convenient, safe and sanitary condition, and also be capable of retaining such sanitary condition while being handled, and the contents thereof consumed, by school children and adults alike. Where straw opening means are provided on such containers, such means must also measure up to the convenient, safe and sanitary requirements.

2. Background Art

U.S. Pat. No. 3,770,185 provided for a straw opening means wherein parallel score lines are cut from one side and a circular score line is cut from the opposite side of one vertical wall above the gable, each to a depth of from 40 to 75 percent of the wall thickness. Such score lines form a tear strip extending from the upper vertical edge, along the width of the vertical wall and onto one gable. A "thumb notch" is formed on the uppermost edge of the other vertical wall to facilitate the opening process. Once the tear strip is torn away along the lines defined by the parallel score lines, a plug of material encompassed by the circular score line remains intact with the tear strip to expose a hole for receiving a straw.

DISCLOSURE OF INVENTION

Accordingly, an object of the invention is to provide an improved liquid carrying container including means for readily forming a sanitary straw opening therein without having to open the conventional pouring spout.

Another object of the invention is to provide a liquid carrying, paperboard container including an improved straw opening means associated with a supported portion of a gable top roof panel.

A further object of the invention is to provide a liquid proof, thermoplastic coated paperboard container including a tear strip formed integral with a roof panel adjacent the edge thereof which overlies the upper extension of a conventional side seam flap.

Still another object of the invention is to provide a plastic coated, gable top type container including straw opening means consisting of a tear strip formed on the side seam-supported end of one roof panel by spaced laterally-extending die cuts formed through the outer plastic layer and from one half to all the way through the paperboard layer, and extending from a side edge of the roof panel, across the width of the underlying side seam, and a predetermined distance beyond the free edge of the side seam, defining a flexible hinge between the distal ends thereof when the tear strip is pealed back from the edge of the roof panel, whereupon the clean, weakened area thus uncovered may be penetrated by manually pressing a straw thereagainst.

A still further object of the invention is to provide a container with such straw opening means and, additionally including a pair of crossed lines formed by die cuts through the inner plastic layer and from one half to all the way through the paperboard layer, thereby providing easy access for the insertion of a straw once the tear strip is pealed back to the flexible hinge.

These and other objects and advantages of the invention will be apparent when reference is made to the following description and accompanying drawings:

BEST MODE FOR CARRYING OUT THE INVENTION

Figure 1:
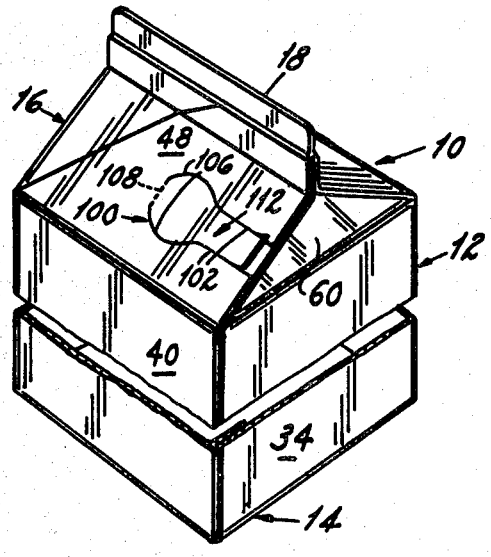
FIG. 1 is a fragmentary, rear perspective view of a closed and sealed paperboard container embodying the invention.

Referring now to the drawings in greater detail, FIG. 1 illustrates a container 10. The container is formed from kraft paperboard and is self-sustaining in shape. To render the paperboard fluid-tight and capable of holding such acidic liquids as milk, the paperboard is covered on both sides with a suitable thermoplastic material, such as polyethylene.

The container 10 includes a tubular body 12 which, in the present instance, is substantially square in cross section. At its base the body 12 is provided with a suitable bottom closure 14. The upper end of the body 12 terminates in what will be recognized as the familiar gable top end closure 16 which is surmounted by a central laminar rib or truss 18. The top end closure has incorporated therein an extensible spout (FIG. 3) for dispensing the contents of the container.

The container 10 is formed from a flat blank 20 (FIG. 2) of high-grade paperboard coated with outer and inner layers of polyethylene thermoplastic material. By means of an appropriate pattern of score lines, the blank 20 is divided into a plurality of panels and sections which are utilized for the walls of the container and the closure parts when the container is erected. The central and major area of the blank becomes the body 12 of the container and is defined by spaced apart transverse score lines 22 and 24, running in substantially parallel relation across the face of the blank. Intersecting the lines 22 and 24 at spaced intervals therealong are a series of perpendicular score lines 26, 28, 30 and 32, which define, in the central and major area of the blank, side panels 34, 36, 38 and 40 together with a fractional side panel or side seam flap 42, sometimes referred to as the "fifth panel". When the container is erected the latter is adhesively secured in overlying relation with the side panel 34.

It should be noted that the transverse score lines 22 and 24 are not continuous but are formed in staggered portions interrupted by the perpendicular score lines 26, 28, 30 and 32. The purpose of this staggered scoring is to accommodate the thickness of the paper as the paper is bent along the score lines when the container is erected and thus prevent crowding of the paper at the various junctions of the score lines. This not only enhances the strength and appearance of the finished container but facilitates its erection and closure by automatic machinery.

Integral with the upper ends of the side panels, but separated therefrom by the transverse score line 22, are a plurality of panel extensions which give the top of the container 10 its characteristic gable shape. These areas include a transverse score line 44 disposed generally parallel to the score line 22 and spaced between the latter and the top edge of the blank 20. The areas below the line 44 define the roof panels and end panels of the top closure while the areas above the line 44 define the parts of the central laminar rib 18. The score line 44 is not a straight line but includes staggered portions 44*a*, 44*b*, 44*c* and 44*d* corresponding respectively to the panels 34, 36, 38 and 40, for accommodating the thickness of the paper when the container closure is folded.

Figure 2:
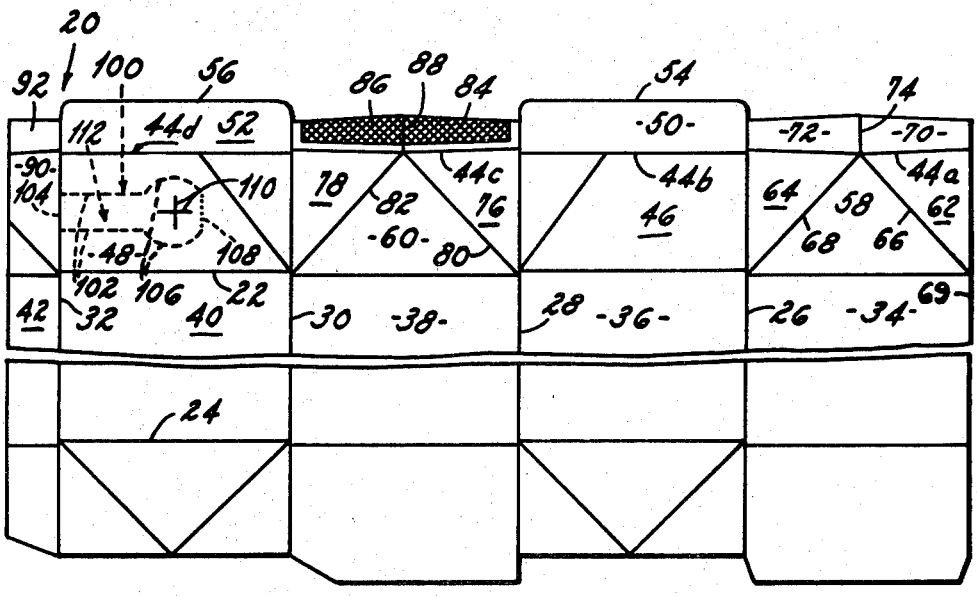
FIG. 2 is a layout view of a blank from which the container in FIG. 1 is erected and showing the inside surface thereof.

Alternate side panels 36 and 40 have respectively connected therewith inclined roof panels 46 and 48. The latter, in turn, are connected with outer rib panels 50 and 52 terminating, respectively, in sealing flaps 54 and 56 integral therewith. Similarly, alternate side panels 34 and 38 have connected therewith along the staggered transverse score line 22 triangular end panels 58 and 60. The triangular end panel 58 is flanked by triangular fold-back panels 62 and 64 connected along converging score lines 66 and 68. The latter start at the intersections of the score line 22 and the right-hand edge 69 of the blank 20 (as shown in FIG. 2) and the perpendicular score line 26, respectively, and converge upwardly, intersecting at the approximate midpoint of transverse score line 44*a*. A pair of inner rib panels 70 and 72 are connected to the panels 62 and 64, along the score line 44*a* and are connected to each other along a short vertical score line 74, which runs from the apex of the end panel 58 to the top edge of the blank. By the same token, end panel 60 is flanked by fold-back panels 76 and 78, connected along converging score lines 80 and 82. Fold-back panels 76 and 78 are connected to another pair of inner rib panels 84 and 86 along the score line 44*c*, the panels 84 and 86 being connected with each other along a score line 88.

A panel extension 90 is formed as an upper extension of the side seam flap 42, connected therewith along the score line 22, and connected to the roof-panel 48 along the score line 32. A further panel extension 92 is, in turn, formed as an upper extension of the panel extension 90, connected therewith along the score line 44, and connected to the outer rib panel 52, along the score line 32.

When the container 10 is erected, the extensions 90 and 92 overlie the inner surfaces of the marginal edge portions of the triangular fold-back panel 62 and the inner rib panel 70, respectively, causing the edge 69 of the blank 20 to be positioned adjacent the score line 32, with the panel extension 90 serving as an inner layer support means for the adjacent end portion of the roof panel 48.

The blank 20 is transformed into a completed container as illustrated in FIG. 1, by first folding it upon itself to form a flat tube and adhesively securing the side seam flap 42 and its extensions 90 and 92 to the inside faces of panels 34, 62 and 70.

The flattened blank tube is then erected into a tube of substantially square cross section (FIG. 6) and the bottom closure is completed in a manner disclosed and described in U.S. Pat. No. 3,120,335.

To seal the container top closure, the parts thereof are infolded into gable form. During the course of such action the triangular panel crease lines 66, 68, 80 and 82 are broken by infolding the triangular end panels 58 and 60 toward each other. The inner and outer rib panels and sealing flaps 54 and 56 are then heated on both sides, to adhesively activate the polyethylene thermoplastic coating. The container may then be closed by passing its top rib portion between a pair of converging rails, forcing adhesively activated rib panels and sealing flaps together to complete the gable top structure. The rib panels and sealing flaps are thereupon subjected to a predetermined sealing pressure in a conventional manner, leaving the top closure in a sealed condition as illustrated in FIG. 1.

Figure 3:
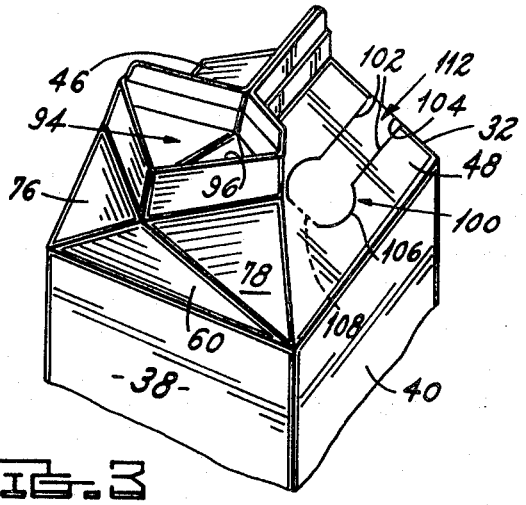
FIG. 3 is a fragmentary front perspective view of the container in FIG. 1, with the pouring spout in its extended position.

As shown particular in FIG. 3, an extensible, sanitarily protected pouring spout 94 of pitcherlike form is incorporated into the top closure of the container 10 and rendered accessible as a result of partial disassembly of the central laminar rib 18. This is accomplished in large measure by taking advantage of the angular arrangement of score lines defining the triangular end panels and fold-back panels of the top closure. The pouring spout 94 accordingly comprises the triangular end panel 60, the triangular fold-back panels 76 and 78, the rib panels 84 and 86, adjacent portions of the outer rib panels 50 and 52, and adjacent portions of the inclined roof panels 46 and 48. The rib panels 84 and 86 provide the spout 94 with a free upper edge 96 which is traversed by fluid poured from the container 10. This edge 96 serves as a pouring lip and affords excellent pouring and cut off characteristics. Prior to being opened, the pouring edge 96 and its adjacent areas on the inner rib panels 84 and 86 are completely and sanitarily sealed within the structure of the laminar top rib 18 and the spout is enclosed with complete sanitary protection.

Referring once again to FIG. 1, it may be noted that, in addition to containing a conventional pouring spout arrangement, provision is also made for the sanitary use of a drinking straw without having to open the pouring spout. As shown in FIG. 2, a die cut 100 is made in the outer or top surface of the roof panel 48, cooperating with the edge thereof formed by the score line 32. The die cut includes parallel lines 102 which extend laterally from a vertical line 104 formed substantially along the center of the score line 32. The length of the line 104 is approximately one third the height of the roof panel 48 and the lengths of the lines 102 are equivalent to at least the width of the panel extension 90. At the inner ends of the lines 102, oppositely disposed arcuate shaped lines 106 are connected thereto, forming a partial circle and adapted to provide a hinge, represented by the dash line 108, intermediate the distal ends of the arcuate shaped lines 106, as will be explained.

The depth of the die cut 100 is controlled so as to extend through the outer layer of polyethylene on the roof panel 48, and from halfway to all the way through the paperboad layer, but not into the inner layer of polyethylene. The roof panel 48 is supported along the end portion thereof beneath the lines 102 by the panel extension 90, once the latter is folded and sealed to the adjacent inner surfaces of the fold-back panel 62 and the triangular end panel 58, and the gable top formed, providing a double layer support means beneath the die cut lines 102 in the roof panel 48.

Figure 4:
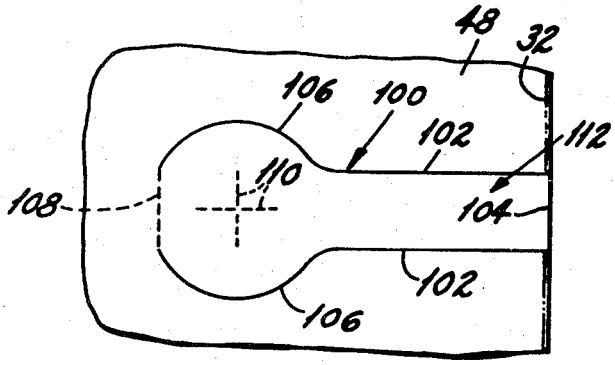
FIGS. 4 and 5 are enlarged, fragmentary views of portions of the FIG. 1 container with the tear strip shown in different operational conditions.
Figure 5:
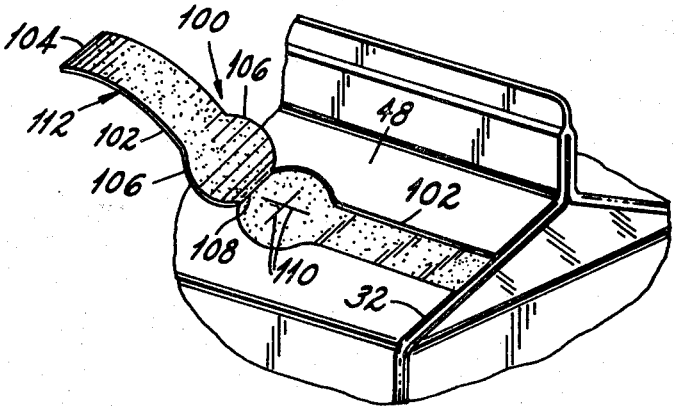

If desired, a +-shaped die cut 110 may be made in the inner or back surface of the roof panel 48 (FIGS. 4 and 5) at approximately the center of the partial circle formed by the arcuate shaped outer lines 106. The die cut 110, if used, is made so as to extend at least through the inner layer of polyethylene and up to halfway through the paperboard, to align with or extend past the depth of the outer die cut 100.

It should be noted that, once the container 10 is folded and sealed, the die cut 100 forms a tear strip 112 (FIG. 5) which may be used in lieu of the pouring spout 94 to provide a sanitary straw hole. This is accomplished by virtue of the cut line 104 providing an exposed edge once the score line 32 has been folded to form the container 10. The resultant edge may be readily engaged by one's fingernail, whereupon the tear strip 112 may then be pealed off the inclined roof panel 48 along the lengths of the lateral and arcuate shaped lines, to thereby render the hinge 108 operative. A straw (not shown) may then be inserted through the +-shaped die cut 110, in communication with the liquid contents within the container 10. If the +-shaped die cut has not been included, the typical straw may be forced through the remaining paperboard thickness and the inner layer of polyethylene at approximately the center of the edges of the partial circle formed by the arcuate lines 106, the adjacent portion of the roof panel 48 being supported by the inner panel extension 90 during the insertion process.

Figure 6:
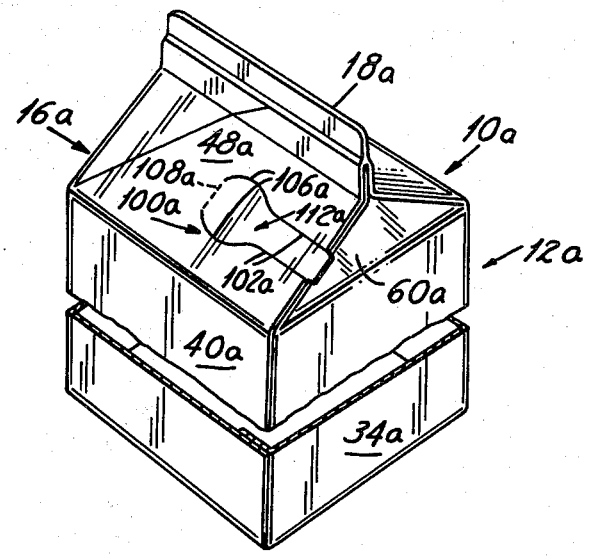
FIG. 6 is a fragmentary, rear perspective view of a closed and sealed paperboard container illustrating an alternate embodiment of the invention.
Figure 7:
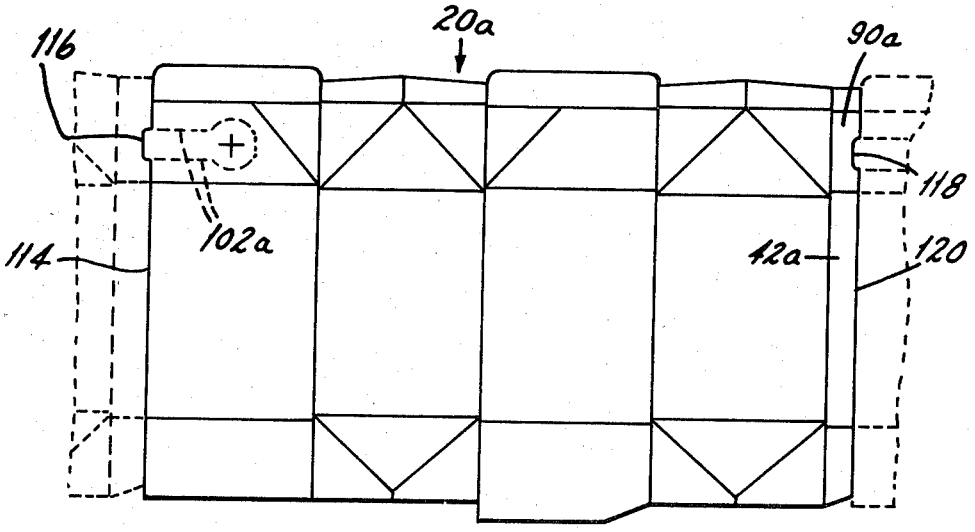
FIG. 7 is a layout view of a blank from which the container in FIG. 3 is erected and illustrating its relationship to adjacent blanks in the cut-off operation.

By referring now to FIGS. 6 and 7, it may be noted that the fractional side panel or "fifth panel" **42*a* is formed on the opposite end of the blank 20*a* as compared to the panel 42 on the blank 20. It's apparent from FIG. 7 that the parallel lines 102*a* terminate at a free edge 114 of the blank 20*a*, rather than at a score line defining adjacent panels, such as the score line 32 of FIG. 2. As such, a tab 116 may be formed as an integral part of the edge 114 adjacent the space between the parallel lines 102*a*. The material for the tab 116 is available from the panel extension 90*a* of the adjacent blank 20*a* on a roll of paperboard which is first scored in the conventional manner and then cut apart into separate blanks including the five (5) panels shown in solid lines in FIG. 7. This results in a notch 118 adjacent the free edge 120 of the side seam flap or fifth panel 42*a* of each blank 20*a***.

It should be apparent from FIG. 6 that, once the gable top end closure **16*a* of the container 10*a* is formed, the panel extension 90*a* still serves as a support means beneath the roof panel 48*a* in the area of the parallel lines 102*a*, now being sealed to the inside surface of the edge portion of the roof panel 48*a***.

The tab 116 provides a convenient and efficient means for pealing the tear strip **112*a* off the inclined roof panel 48*a* along the lengths of the laterial and arcuate shaped lines 102*a* and 106*a***, providing access for the insertion of a straw as discussed above.

Industrial Applicability

It should be apparent that the invention provides a novel, efficient and sanitary means for facilitating the use of a straw with a liquid carrying carton, without having to open the conventional pouring spout thereof. The above described arrangements would be applicable to blanks which are mirror images of the blanks 20 and **20*a***. It should be noted that such straw opening means would also be applicable to a flat top type of liquid carrying container, such as that disclosed in U.S. Pat. No. 4,085,885, for example.

While but two embodiments of the invention have been shown and described, other modifications thereof are possible.

I claim:

1. A method of forming paperboard blanks suitable for liquid carrying containers, said method including the following steps:

(a) scoring a sheet of paperboard with a network of score lines so as to form a plurality of panels suitable for forming the sides, top and bottom of said containers, (b) cutting off individual blanks from the scored sheet such that each blank includes serially aligned first side, front, second side and rear container panels, and a side seam flap adjacent the edge of said first side panel, (c) forming a tear strip in said first side panel by cutting at least halfway through but not all the way through said first side panel along a pair of spaced apart lines beginning at a predetermined location along said first side panel and extending across said first side panel a distance a predetermined amount greater than the overall width of said side seam flap for providing a clean, weakened area in said first side panel beyond said side seam flap when said tear strip is peeled away from said first side panel, and (d) forming a pair of crossed lines by cuts through the inner thermoplastic material and at least halfway through said first side panel and crossing at a point substantially at the center of said pair of spaced apart lines in the area beyond the free edge of said panel extension, to thereby provide easy access for the insertion of a straw once said tear strip is peeled back to the end of said tear strip.

2. A method of forming paperboard blanks suitable for liquid carrying containers, said method including the following steps:

(a) scoring a sheet of paperboard with a network of score lines so as to form a plurality of panels suitable for forming the sides, top and bottom of said containers, (b) cutting off individual blanks from the scored sheet such that each blank includes serially aligned first side, front, second side and rear container panels, and a side seam flap adjacent the edge of said rear panel, said side seam flap having a notch formed at a predetermined location along the free edge thereof, thereby providing material for a tab formed on the free edge of the first side panel of the adjacent blank at the same predetermined location therealong with respect to the end of the blank which is adaptable to forming the top of the container, and (c) forming a tear strip in said first side panel by cutting at least halfway through but not all the way through said first side panel along a pair of spaced apart lines beginning at the junctures of the free edge of said first side panel and the sides of said tab and extending along said first side panel a distance a predetermined amount greater than the overall width of said side seam flap for providing a clean, weakened area in said first side panel beyond said free edge of said side seam flap when said tab and said tear strip are peeled away from said first side panel.

* * * * *